US006581999B1

(12) United States Patent
Chapman

(10) Patent No.: US 6,581,999 B1
(45) Date of Patent: Jun. 24, 2003

(54) RECEPTACLE EXTENSION APPARATUS AND METHOD

(76) Inventor: Jeffrey L. Chapman, P.O. Box 3119, Brunswick, GA (US) 31521

( * ) Notice: Subject to any disclaimer, the term of this patent is extended or adjusted under 35 U.S.C. 154(b) by 0 days.

(21) Appl. No.: 09/683,859

(22) Filed: Feb. 22, 2002

(51) Int. Cl.[7] ..... B60P 1/64; B62C 1/06

(52) U.S. Cl. ..... 296/26.04; 296/51; 298/23 S; 298/23 A

(58) Field of Search ..... 296/3, 32, 36, 296/51, 26.04, 26.02, 26.01, 26.05, 26.06, 26.07; 298/23 S, 23 M, 23 A; 292/11, 26, 48, 30, 53

(56) References Cited

U.S. PATENT DOCUMENTS 434,342 A * 8/1890 Jones ..... 29/57
1,044,271 A * 11/1912 Sharp ..... 296/32
1,740,755 A * 12/1929 Wackerow ..... 296/36
1,828,684 A * 10/1931 Scarlett ..... 220/4.28
2,355,794 A * 8/1944 Gentry ..... 296/104
2,751,248 A * 6/1956 Kritser ..... 296/12
2,856,225 A * 10/1958 Selzer ..... 296/13
3,475,046 A * 10/1969 Webster ..... 296/24.1
4,199,186 A * 4/1980 Faverino ..... 105/1.2
4,703,969 A * 11/1987 Rayburn et al. ..... 296/10
4,762,345 A * 8/1988 Stluka et al. ..... 292/201
5,890,757 A * 4/1999 Masterson et al. ..... 296/100.02
6,152,510 A * 11/2000 Newsome ..... 296/10

* cited by examiner

*Primary Examiner*—D. Glenn Dayoan
*Assistant Examiner*—Patricia Engle
(74) *Attorney, Agent, or Firm*—Rigdon Patents & Engineering, P.C.; Jonathan R. Smith

(57) ABSTRACT

The volume capacity of a hook lift or roll-off truck container body is increased temporarily by vertical extension of the container body's walls and rear door. The extension includes three walls and another door which are firmly attached to the top edges of the container body's walls and doors. The extension is conveniently secured to the body and the doors of the body and the extension open and latch in concert.

15 Claims, 6 Drawing Sheets

RECEPTACLE EXTENSION APPARATUS AND METHOD

BACKGROUND OF INVENTION

This invention relates to the class of article known as receptacles, more specifically to articles designed for removable attachment to an existing receptacle so as to enlarge the capacity of the existing, receptacle. This invention relates still more specifically to enlarging the volume capacity of open-top containers used to transport dry materials by truck, by extending the container walls in a vertical direction. These types of containers are known in the industry as roll-off and hook lift container bodies because they are configured to be picked up by, dumped, and removed from trucks having so-called roll-off and hook lift beds. The contents of the container bodies typically may be dumped by opening a rear door on the container body and elevating the front of the truck bed so as to tilt the container body rearward.

SUMMARY OF INVENTION

The present invention includes an apparatus for temporarily increasing the capacity of a truck container body by extending its vertical walls upward. It also includes the combined extension and container body. To be useful, such extension must preserve the ability to dump the container body by fully opening at the rear. The rear wall of the apparatus is hinged for opening and is fixed to the rear door of the container body so that both open cooperatively.

Roll-off and hook lift container bodies typically are manufactured in various capacities, such as 20 cubic yard and 40 cubic yard, and they are purchased by material haulers in one or more of these size to satisfy their own or their customers' needs. For example, a waste management company might lease either 20 or 40 cubic yard container bodies to construction companies to contain refuse according the amount of refuse generated and the space available for the container body on the construction site. Because the smaller container bodies cost less than the larger ones and take up less space on site, the waste management company tries to keep in inventory the proper mix of capacities to satisfy all customers' needs while minimizing the investment in container bodies. This invention provides an apparatus that creates more flexibility in inventory by allowing smaller container bodies to be converted temporarily to larger capacity when larger container bodies are not available, but at a lesser cost than a complete larger container body.

Objects of this invention are a) to provide an extension that may be removably attached to the top edge of a container body to increase its volume capacity; b) to increase the capacity at less cost than buying an entire larger container body, c) to enable one person to attach and detach the extension from the container body; d) to allow the dump door on the container body to continue to operate normally and in concert with the extension; and e) to enable extension apparatuses to be stacked one on top of the other in storage.

DETAILED DESCRIPTION

Figure 1:
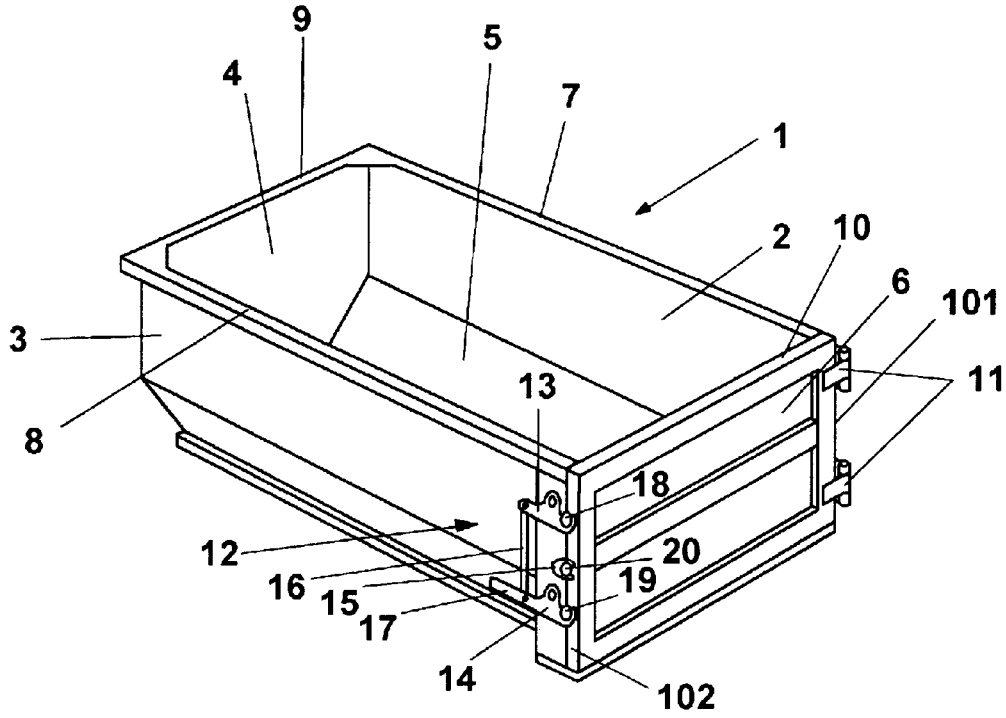
Fig. 1 (prior art)
FIG. 1 depicts a prior art container body shown in perspective view from its upper left rear.

Referring now to in greater detail to the figures, in which like reference numerals depict like features in each figure, FIG. 1 depicts a typical prior art hook lift container body 1 shown in perspective view from its upper left rear. ("Rear" in these drawings means as seen from the rear of a vehicle carrying the container body.) The container body comprises a right vertical wall 2, a left vertical wall 3, a front wall 4, a sloped bottom 5, and a rear door 6, which together form an open-topped box of substantially rectangular shape. Atop the walls are a right sill 7, a left sill 8, a front sill 9, and a door sill 10. Door 6 is swingably attached at a first vertical edge 101 to right wall 2 by hinges 11.

Door 6 must by held closed tightly in transit and readily opened for dumping. Door 6 is closed and latched by latch assembly 12, which comprises two latches, an upper latch 13 and a lower latch 14, rotatably fixed to the outside of left wall 3 near the wall's rear edge. The latch assembly further comprises a striker notch 15, an arm 16 connecting the two latches 13 and 14, an a handle 17 on lower latch 14. When door 6 is closed, the latches tightly hold upper door pin 18 and lower door, pin 19 on the second vertical edge 102 of door 6. A middle door pin 20 rests in striker notch 15. (See detail view in FIG. 6.)

Door 6 is opened by manually pulling upward on handle 17, causing latches 13 and 14 to rotate clockwise (in this view) releasing door pins 18 and 19 respectively and allowing door 6 to open rearwardly. The door is closed again by manually pushing door 6 until middle pin 20 hits and seats in striker notch 15, which serves to assure proper alignment of the door before latching. Handle 17 is then pushed down to rotate latches 13 and 14 into engagement with door pins 18 and 19. Usually, such container bodies comprise means (not shown) for locking handle 17 in the down or up position to assure positive closure or release, respectively.

Figure 2:
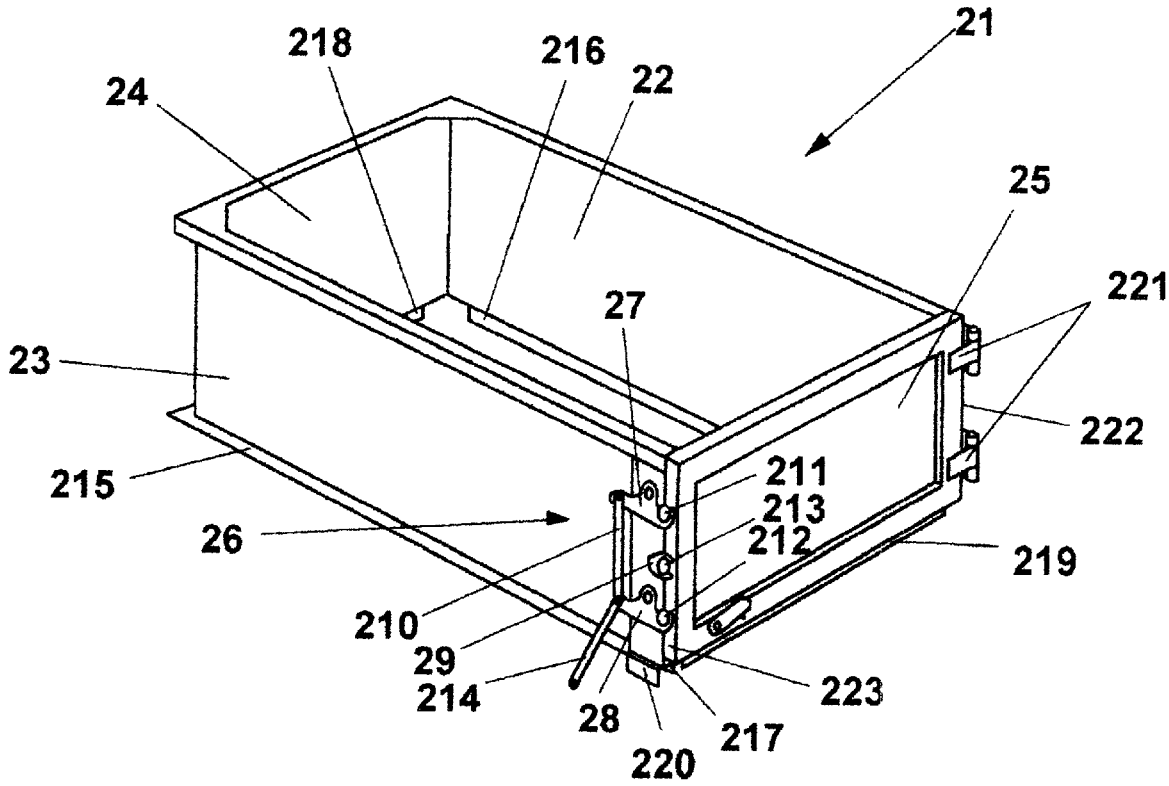
FIG. 2 is a perspective view of the extension from the upper left rear with the rear door closed.

FIG. 2 is a perspective view of the extension 21 from the upper left rear. It comprises a right wall 22, left wall 23, front wall 24, and rear door 25, the door 25 shown in the closed position. These parts define a rectangular space having an open top and bottom. Door 25 is attached swingably at third vertical edge 222 to right wall 22 by hinges 221. Door 25 is closed and latched by latch assembly 26 (similar to that of the container body of FIG. 1) which comprises an upper latch 27, a lower latch 28, a striker notch 29, and an arm 210 connecting the two latches 27 and 28. Latches 27 and 28 engage upper pin 211 and lower pin 212 on a fourth vertical edge 223 of door 25, and striker notch 29 engages a middle pin 213 so as to align the door upon closing. An elongate connector 214 is rotatably attached at one end to lower latch 28. The lower edges of the walls 22, 23 and 24 have a rigid flange 215 welded to them and extending horizontally outward from them. Depending vertically from the walls 22, 23, and 24 and from door 25 (and only partially visible in this view) are guide strips 216, 217, 218 and 219 respectively. Also depending from the bottom edge of the rear end of left wall 23 and spaced outwardly from guide strip 217 is locating tab 220. Similar locating tabs, not seen in this view but illustrated in FIG. 3, depend from the bottom edge of the rear end of right wall 22 and the from the center of the bottom edge of front wall 24.

The extension 21 functions to increase the volumetric capacity of the container body 1 of FIG. 1 when it is placed on top of it so that flange 215 rests directly on sills 7, 8 and 9 of FIG. 1. Satisfactory alignment of the flange and the sills is assured when guide strips 216, 217 and 218 are positioned inside walls 2, 3, and 4 respectively. Guide strip 219 is positioned inside door 25.

Figure 3:
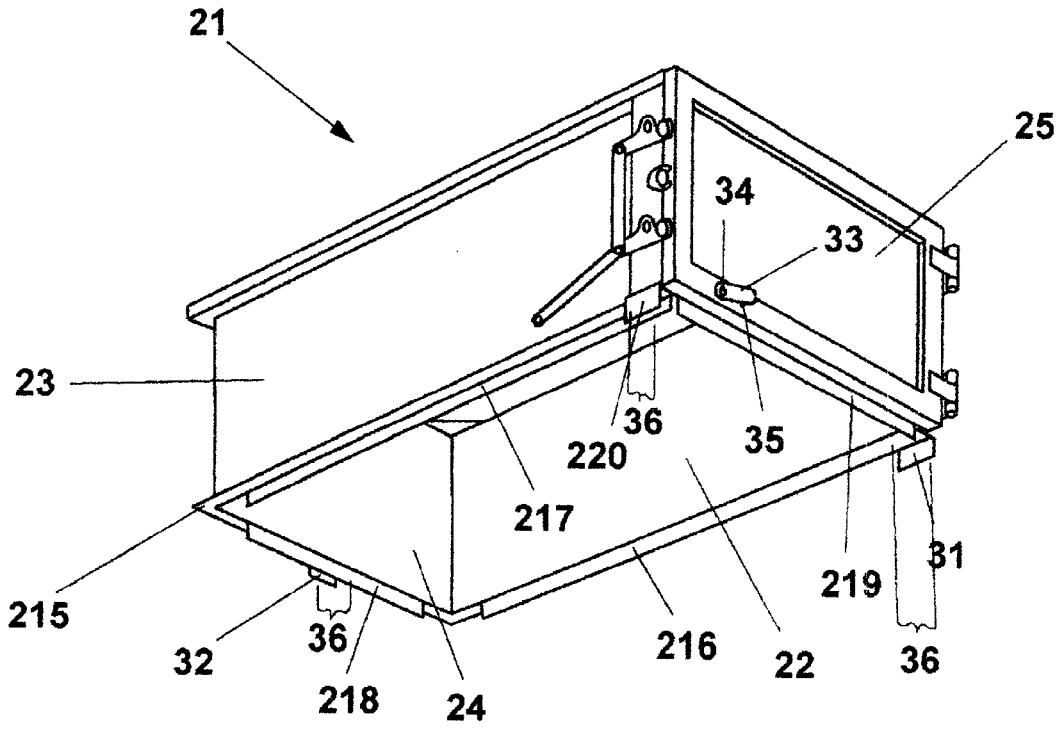
FIG. 3 is a perspective view of the extension from the lower left rear.

FIG. 3 is a perspective view of the extension 21 from the lower left rear to better show the guide strips and locating tabs. Again note locating tab 220 depending from left wall 23 and spaced outwardly from guide strip 217. Depending from right wall 22 and front wall 24 and spaced outwardly from guide strips 216 and 218 respectively are right locating tab 31 and front locating tab 32. The function of these locating tabs and guide strips is to assist in centering the bottom flange 215 of the extension directly on top of the sills of the container body, and to prevent lateral or longitudinal movement of the extension with respect to the container body during use. The tabs are spaced outwardly from their respective guide strips just enough to accommodate the container body sills, thereby acting as sill centering means 36 when the extension 21 is lowered into place (see FIG. 5).

To aid in connecting door 25 with door 6 on the prior art container body (see also FIGS. 5 and 6) a retainer tab 33 is provided rotatably connected to door 25 by bolt 34 and kept from swinging downward until needed by pin 35 protruding from door 25.

Figure 4:
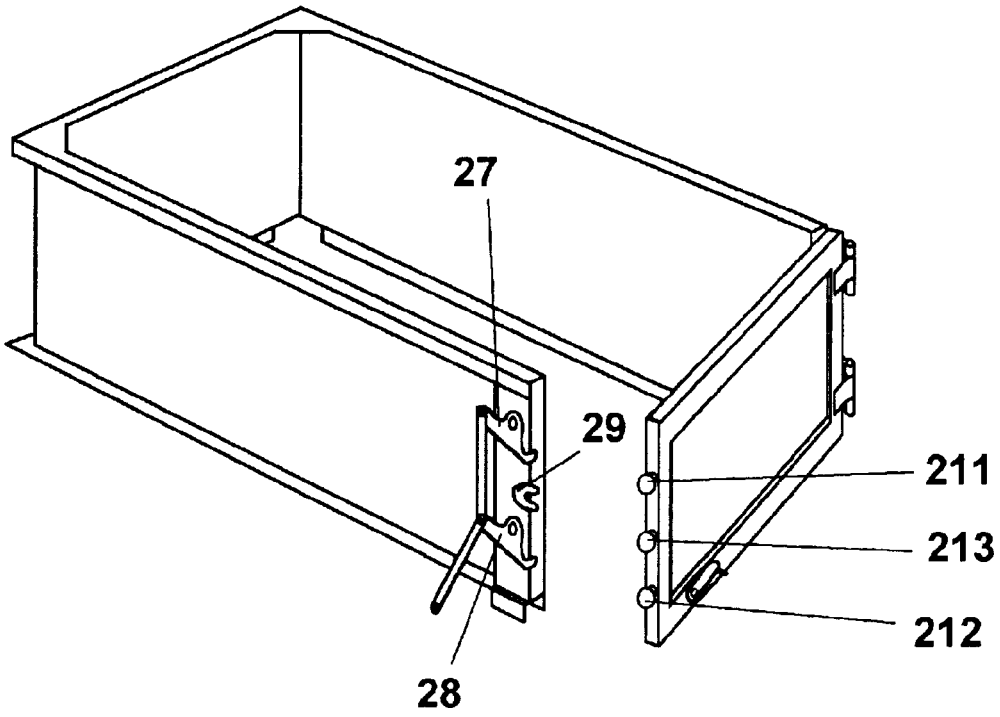
FIG. 4 is the extension with its rear door partially open.

FIG. 4 is the extension with its rear door partially open. Note that latches 27 and 28 are rotated in a clockwise direction compared with their positions in FIG. 2 so as to release upper and lower door pins 211 and 12 respectively and allow middle door pin 213 to move away from striker notch 29.

Figure 5:
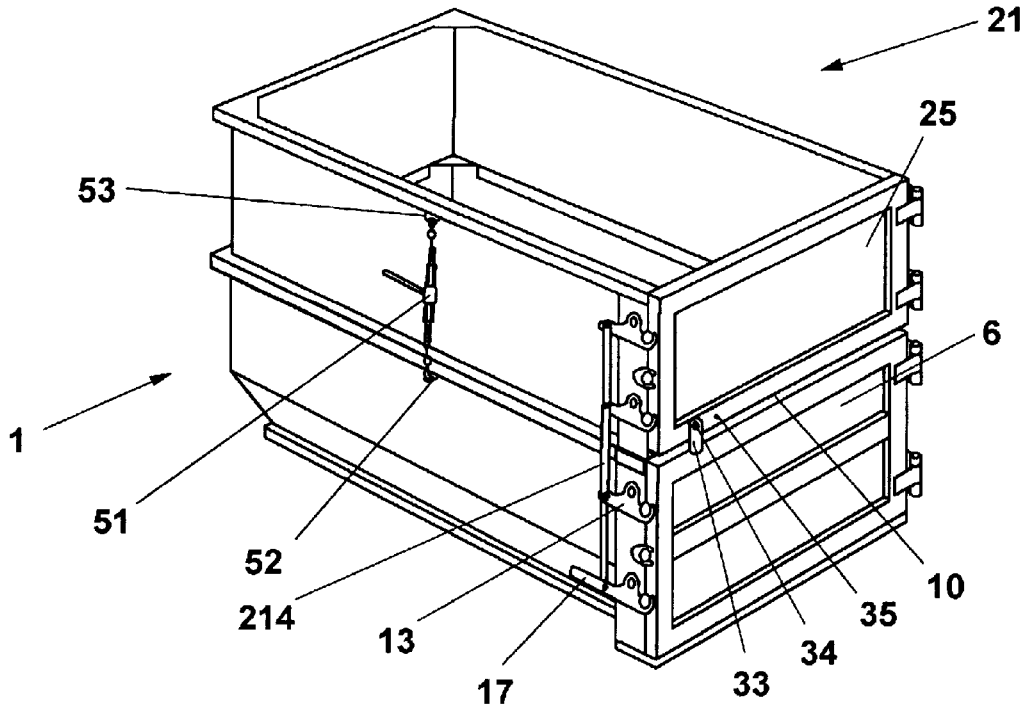
FIG. 5 is an upper left rear perspective view of the extension attached to a container body with the doors closed.

FIG. 5 is an upper left rear perspective view of the extension 21 attached to the container body 1. To attach the two so that they operate as a single container, it is necessary to attach the lower end of elongate connector 214 to the front portion of latch 13, thereby forcing all four door latches to operate in concert when handle 17 is pulled upward. (See also detail in FIG. 6.) Further, it is necessary to fasten the entire extension 21 down onto the container body 1 to assure they stay together in use. One way to do this is to provide attachment eyes 52 and 53 on the sides of the container body I and the extension 21 respectively, connect the ends of a ratcheting turnbuckle 51 to eyes 52 and 53, and tighten. (This turnbuckle assembly is shown on the left side of the extension in FIG. 5 and is duplicated out of view on the right side.) For convenience and protection against theft, the turnbuckle 51 may be permanently flexibly attached to the extension, for example, by means of a welded link to eye 53. An easy means of attachment like a turnbuckle or come-along is preferred to simplify binding the extension to the container body, but other secure means of attachment may be used in combination with the extension and container body and are considered within the scope of this invention without limitation. The upper and lower ends of the attachment means may alternatively be affixed to the extension and container body by eyes and bolts, pins or keys secured through holes drilled in the extension and container body. Such alternative fastening means are considered within the scope of this invention without limitation. The final step in attaching the extension to the container body is to rotate retainer tab 33 counterclockwise about bolt 34 from its position in FIG. 3 into a vertical direction extending below the edge of door sill 10. This traps the sill 10 of door 6 between retainer tab 33 and guide strip 219 on door 25. (Only the extreme left end of guide strip 219 is visible in this view.) Thus confined, door 6 can only open in concert with door 25. Other means of fastening the doors together temporarily, such as by a sliding bolt on door 25 and a keeper in door 6, are to be considered within the scope of this invention without limitation.

Figure 6:
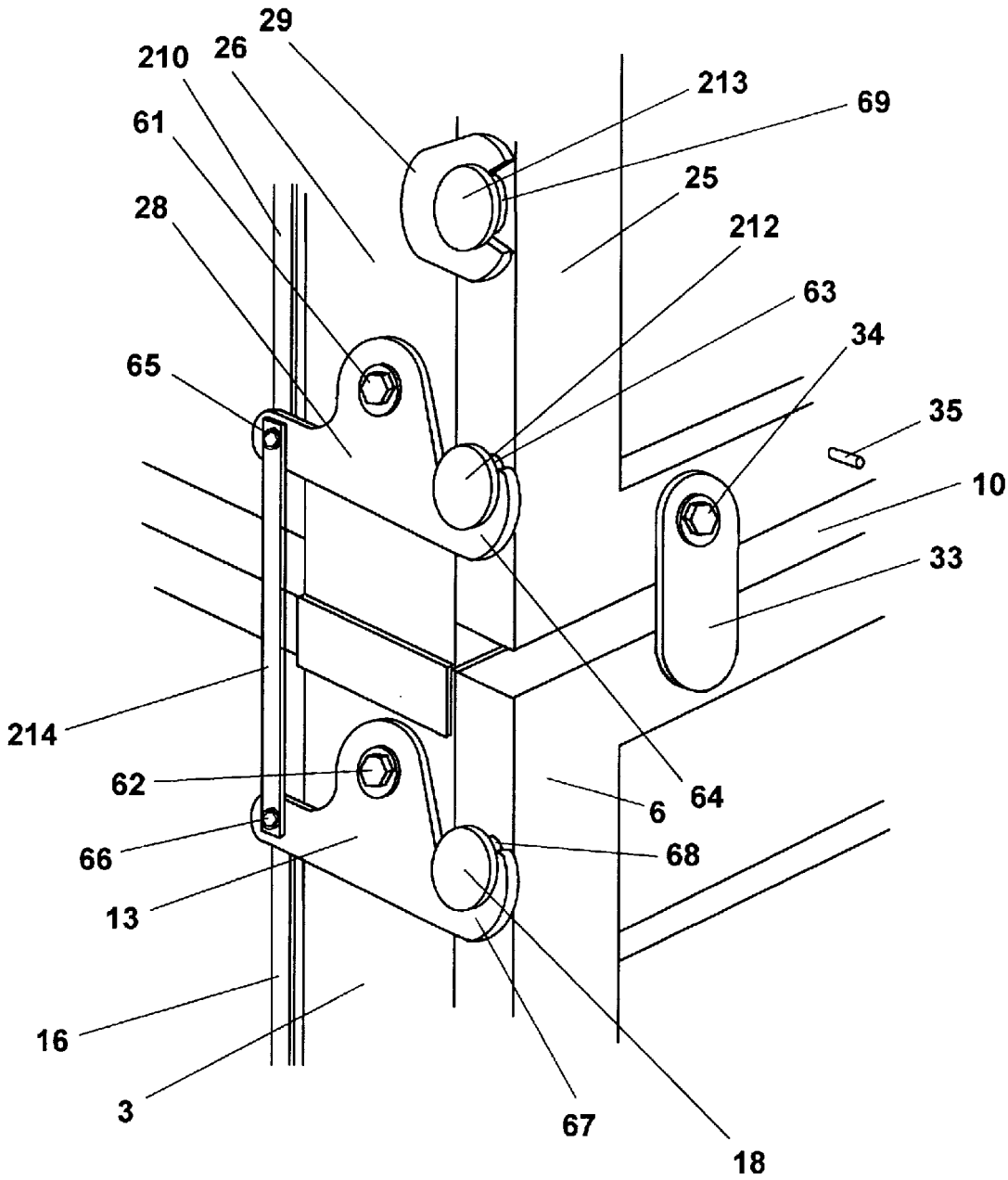
FIG. 6 is a detail perspective view of the joined door latch mechanisms of the extension and container body.

FIG. 6 is a detail perspective view of the joined door latch mechanisms of the extension and container body, showing how the container body latch assembly (reference 12 in FIG. 1) and the extension latch assembly (reference 26 in FIG. 2) are connected after the extension is positioned on the container body. Latches 13 and 28 are connected to other latches (not shown) by arms 16 and 210, respectively. Arms 16 and 210 are fastened to latches 13 and 28 by fasteners 66 and 65, respectively. The fasteners allow rotation of the latches relative to the arms in a vertical plane, so that when the arms are moved upwardly or downwardly by an external force, the latches rotate clockwise or counterclockwise, respectively, about pivots 61 and 62. For all latches to operate cooperatively, it is necessary to connect latch 28 to latch 13 by means of elongate connector 214. To enable rapid connection of elongate connector 214 to latch 13, fastener 66 may take the for of a snap or keyed pin rather than a bolt. Such other types of fasteners are considered within the scope of the present invention without limitation. The clockwise rotation of all of the now-interconnected latches (caused by lifting handle 17 in FIG. 5) in turn causes hooks 64 and 67 to move downward, releasing necks 63 and 68 of pins 212 and 18 respectively, and allowing connected doors 25 and 6 to open.

Note also in FIG. 6 the detail of striker notch 29 embracing neck 69 of pin 213. Additionally, FIG. 6 shows detail of retainer tab 33 depending rotatably from bolt 34, trapping sill 10 of door 6 between retainer tab 33 and guide strip 219 (hidden) on the lower edge of door 25. Pin 35 holds tab 33 out of the way when tab 33 is rotated clockwise from the vertical to the horizontal when the extension is removed from the container body. In a similar fashion, elongate connector 214 may be rotated clockwise about fastener 65 for stowage by means of a bungee cord or the like (not shown) when the extension is removed from the container body.

What is claimed is:

1. An extension for a truck container body, the truck container body comprising vertical walls and a door, each having top edges and inside and outside faces, and a door latching mechanism, the extension comprising:

extension walls corresponding to, and attached rigidly and removably by wall attachment means to, the top edges of the truck container body walls;

an extension door hung by hinges from one of the extension walls and releasably coupled by door coupling leans to the top edge of the door of the truck container body;

latching means for the extension door further comprising means for interconnection to the door latch mechanism of the truck container body; and the interconnection means causing the latching means for the extension door to be actuated by the latch mechanism of the truck container body.

2. The extension of claim 1 wherein:

said extension and said container body each comprise two side walls and a front wall;

said wall attachment means further comprise side wall guide strips depending from said extension side walls to engage said inside faces of said top edges of said truck container body side walls;

said wall attachment means further comprises a front wall guide strip depending from said extension front wall to engage said inside face of said top edge of said truck container body front wall, said door attachment means further comprises a door guide strip depending from said extension door to engage said inside face of said door of said truck container body, and at least one movable retainer tab rotatably attached to said extension door to engage said outside face of said door of said truck container body.

3. The extension of claim 2 wherein one of said extension walls has an edge forming a door jamb abutting the free end of said extension door, and said latching means further comprises:

a plurality of latches arrayed vertically along the door jamb;

a like number of latch receivers arrayed vertically along the free end of said extension door;

each latch being attached movably to the door jamb so that, when the door is closed and the latches are moved to a first position, the latches grip the latch receivers and hold the door closed, and when the latches are moved to a second position, the latches release the latch receivers and allow the door to be opened;

the latches are operated by a common latch mover so that the latches are always in a common orientation; and said interconnection means further comprises a rigid member having an upper end and a lower end, the upper end flexibly and permanently connected to the common latch mover, and the lower end shaped to be flexibly and removably connected to the door latch mechanism of the truck container body.

4. The extension of claim 3 wherein:

said wall attachment means further comprises sidewall locating tabs depending from said extension side walls to engage said outside faces of said top edges of said truck container body side walls; and said wall attachment means further comprises at least one front wall locating tab depending from said extension front wall to engage said outside face of said top edge of Said truck container body front wall.

5. The extension of claim 4 wherein:

said wall attachment means further comprises means for temporarily securing said extension to said truck container body.

6. The extension of claim 5 wherein:

said temporary securing means further comprises a plurality of clamping means, each having a first end attached to said extension and a second end attached to said truck container body.

7. The extension of claim 6 wherein:

each of said clamping means is flexibly fixed at said first end to said extension; and each of said clamping means is either a) a turnbuckle; b) a come-along; c) a cable puller; or d) a ratchet strap.

8. The extension of claim 7 wherein:

said movable retainer tab can be stowed in a horizontal position and moved to a vertical position.

9. The combination of a truck container body and a container body extension therefor, comprising:

a rigid truck container body comprising a first container body side wall, a second container body side wall, a container body front wall, a bottom, and a container body door;

the container body door having a first vertical edge and a second vertical edge;

the first vertical edge being rotatably connected to the first container body side wall on container body door hinges, the second vertical edge having at least one container body latch receiver;

the second container body side wall having a number of container body latches corresponding to the number of container body latch receivers;

a manual container body latch mechanism that allows one hand motion to cause the container body latches to grip the container body latch receivers;

the container body side walls, front wall, and door having sills along their top edges;

the container body side wall sills having clamp receiving means;

a rigid container body extension comprising a first extension side wall, a second extension side wall, an extension front wall, and an extension door;

the extension walls and door having lower edges, the lower edges having container body sill centering means depending therefrom;

the extension door having a third vertical edge and a fourth vertical edge;

the third vertical edge being rotatably connected to the first extension side wall on extension door hinges, the fourth vertical edge having at least one extension latch receiver;

the second extension side wall having a number of latches corresponding to the number of extension latch receivers;

an extension latch mechanism that allows one motion to cause the extension latches to grip the extension latch receivers;

a rigid elongate connector having an upper end and a lower end, the upper end being rotatably fixed to the extension latch mechanism;

the lower end being rotatably fixed to the container body latch mechanism, causing the extension latch mechanism to operate in concert with the container body latch mechanism;

the shape of the elongate connector being such that the same hand motion on the manual container body latch mechanism that causes the container body latches to grip the container body latch receivers also causes the extension latches to grip the extension latch receivers;

the extension side walls further comprising adjustable clamping means having a top end and a bottom end, the top end flexibly attached thereto;

the bottom end having sill attachment means;

the sill attachment means being attached to the clamp receiving means on the container body wall sills; and the clamp being adjusted to draw the extension tightly to the container body.

10. The combination of claim 9 wherein:

said sill centering means comprises straight rigid strips depending fixedly from said lower edges of said extension walls and positioned so as to fit slidingly inside said sills of said container body when said extension is lowered onto said container body; and said elongate connector comprises a rigid bar rotatably and removably fixed to said container body latch mechanism and said extension latch mechanism, the bar being of such a length to cause all of said container body latches and said extension latches to be oriented in the same direction at the same time.

11. The combination of claim 10 wherein:

said sill attachment means on said adjustable clamping means is a hook with an upward-facing tip, and said clamp receiving means is either:

a) an eye formed of rigid material and fixed to said sill so that the axis of the eye is vertical, the diameter of the eye being sufficient to releasably hold the tip, and the eye being formed of rigid material and fixed to said sill so that its axis is vertical, or b) a cavity formed into said sill shaped to releasably hold said tip.

12. The combination of claim 11 wherein said extension door further comprises:

means for releasably holding said extension door in coplanar relation to said container body door.

13. The combination of claim 12 wherein said holding means further comprises:

a straight rigid strip depending fixedly from the bottom inside edge of said extension door, positioned to slidingly engage said sill of said container body door; and a retainer tab rotatably attached to the bottom outside edge of said extension door in such a position that when it is rotated upwardly, it is higher in its entirety than the lower edge of said straight rigid strip, and when it is rotated downwardly, a portion of it is below the top edge of said container body door sill.

14. The combination of claim 13 wherein said sill centering means further comprises:

a plurality of rigid locator tabs depending from said extension walls and spaced outwardly from said strips so as to fit slidingly outside said sills of said container body when said extension is lowered onto said container body.

15. A method for increasing the capacity of a open-topped truck container body having two side walls, a front wall, and a rear door, each having sills along their upper edges, and the door being hinged along a vertical axis to the rear end of one of the side walls, the rear end of the other side wall having means for latching the container body door closed, the method employing a vertical extension of the container body walls and door having an open top and bottom, vertical front and side extension walls and extension door, the extension door being hinged on along a vertical axis to the rear end of an extension well on the same side as the hinges on the container body door, the other extension wall having means for latching the extension door closed, the extension walls and door having lower edges, the lower edges equipped with means for centering the lower edges on the sills of the truck container body, means for clamping the extension walls to the container body walls, means for releasably coupling the extension door to the container body door, and having means for interconnecting the means for latching the container body door to the means for latching the extension door, the method comprising the steps of:

a. closing and latching both container body and extension doors;

b. suspending the extension above the container body;

c. aligning said extension wall centering means above the container body sills;

d. lowering the extension until the extension wall centering means guide the lower edges of the extension walls fully into contact with the container body wall sills;

e. clamping the extension walls to the container body walls;

f. interconnecting the extension door latching means to the container body door latching means; and g. coupling the extension door to the container body door.

* * * * *